US007993210B1

(12) United States Patent
Hatfield

(10) Patent No.: US 7,993,210 B1
(45) Date of Patent: Aug. 9, 2011

(54) GOLFING APPARATUS

(76) Inventor: Michael Luke Hatfield, Quispamis (CA)

( * ) Notice: Subject to any disclaimer, the term of this patent is extended or adjusted under 35 U.S.C. 154(b) by 0 days.

(21) Appl. No.: 12/777,346

(22) Filed: May 11, 2010

Related U.S. Application Data

(60) Provisional application No. 61/178,273, filed on May 14, 2009.

(51) Int. Cl.
*A63B 69/36* (2006.01)

(52) U.S. Cl. ..... 473/215; 473/229

(58) Field of Classification Search ..... 473/207, 473/215, 216, 219, 223, 226, 227, 229, 266, 473/277, 458
See application file for complete search history.

(56) References Cited

U.S. PATENT DOCUMENTS 2,773,691 A 12/1956 Redfield
4,479,653 A 10/1984 Woodson
4,852,782 A * 8/1989 Wu et al. ..... 224/661
5,150,901 A * 9/1992 Stawicki ..... 473/215
5,308,071 A 5/1994 Lewis
5,441,271 A * 8/1995 Briggs ..... 473/215
5,531,446 A 7/1996 Scheie
5,658,203 A * 8/1997 Shub ..... 473/205

* cited by examiner

*Primary Examiner* — Nini Legesse
(74) *Attorney, Agent, or Firm* — L.C. Begin & Associates, PLLC

(57) ABSTRACT

One embodiment of a golfing apparatus for assisting a golfer in playing golf includes an belt member adapted to be wrapped around a waist of the golfer. The belt member includes a groove. Further, the golfing apparatus includes an attaching member carried by end portions of the belt member. The attaching member is adapted to secure the belt member to the waist of the golfer. Furthermore, the golfing apparatus includes a guiding member adapted to receive a handle portion of a golf club. The guiding member is slidably engaged in the groove to enable a free movement of the guiding member therein. The free movement of the guiding member in the groove guides a swing of the golf club received in the guiding member, thereby assisting the golfer in playing golf.

9 Claims, 7 Drawing Sheets

GOLFING APPARATUS

CROSS REFERENCE TO RELATED APPLICATION

This application claims the benefit of U.S. Provisional Application No. 61/178,273 filed on May 14, 2009, the disclosure of which is incorporated by reference.

FIELD OF THE DISCLOSURE

The present disclosure generally relates to a golfing apparatus, and, more particularly, to an apparatus that assists a golf player while playing golf.

BACKGROUND OF THE DISCLOSURE

Various golfing equipments, such as golf clubs, golf balls, and tee markers, are utilized by golfers while playing golf. In addition to such golfing equipments, other equipments, such as golf carts, and golfing bags, are also utilized by golfers while playing golf.

Putting is an important aspect of golf. During putting, the golfers generally bend towards a golf ball, and hit the golf ball by a golf club for displacing the golf ball towards an aimed hole on the golf course.

However, such striking of the golf ball often fails to displace the golf ball substantially closer to the aimed hole. Accordingly, golfers both experienced and beginners repeatedly practice putting strokes aiming to accurately put the golf ball in the aimed hole. However, since arms and body of golfers are unrestrained, every golf stroke may result in a different swing of the golf club. Moreover, since the golfers generally bend while hitting the golf ball, back and body portion of the golfers often comes under considerable stress. Such stress often creates various posture and health related problems for the golfers.

SUMMARY OF THE DISCLOSURE

One embodiment of a golfing apparatus for assisting a golfer in playing golf may include a belt member adapted to be wrapped around a waist of the golfer. The belt member may include a groove. Further, the golfing apparatus may include an attaching member carried by end portions of the belt member. The attaching member may be adapted to secure the belt member to the waist of the golfer. Furthermore, the belt member may include a guiding member slidably engaged in the groove. The slidable engaging of the guiding member in the groove may enable a free movement of the guiding member in the groove. Further, the guiding member may be adapted to receive a handle portion of a golf club therein. The free movement of the guiding member in the groove may guide a swing of the golf club received in the guiding member, thereby assisting the golfer in playing golf.

BRIEF DESCRIPTION OF THE DRAWINGS

The advantages and features of the present disclosure will become better understood with reference to the following detailed description and claims taken in conjunction with the accompanying drawing, in which:

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to a particular a golfing apparatus as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms, "first," "second," "top," "bottom," and the like, herein do not denote any order, elevation or importance, but rather are used to distinguish one element with another. Further, the terms, "a" and "an" herein do not denote a limitation of quantity, but rather denote the presence of at least one of the referenced item.

The present disclosure provides a golfing apparatus for assisting a golfer in playing golf. Specifically, the golfing apparatus may be attached to a waist of the golfer. A golf club may be attached to the golfing apparatus. The golfing apparatus is adapted to guide the swing of the golf club, thereby assisting the golfer in taking putting shots. Further, the golfing apparatus also assists the golfer in maintaining a proper posture.

Figure 1:
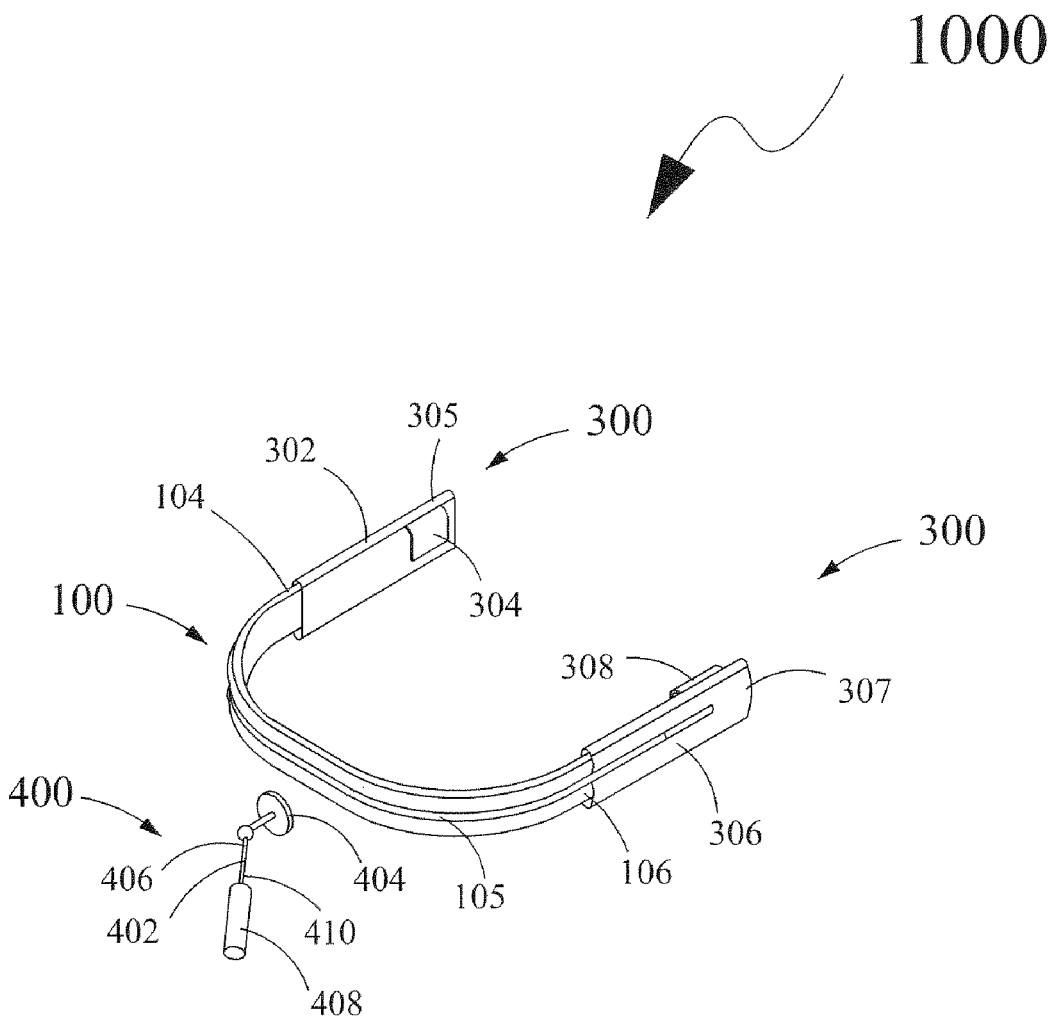
FIG. 1 is an exploded view of one embodiment of a golfing apparatus.
Figure 2:
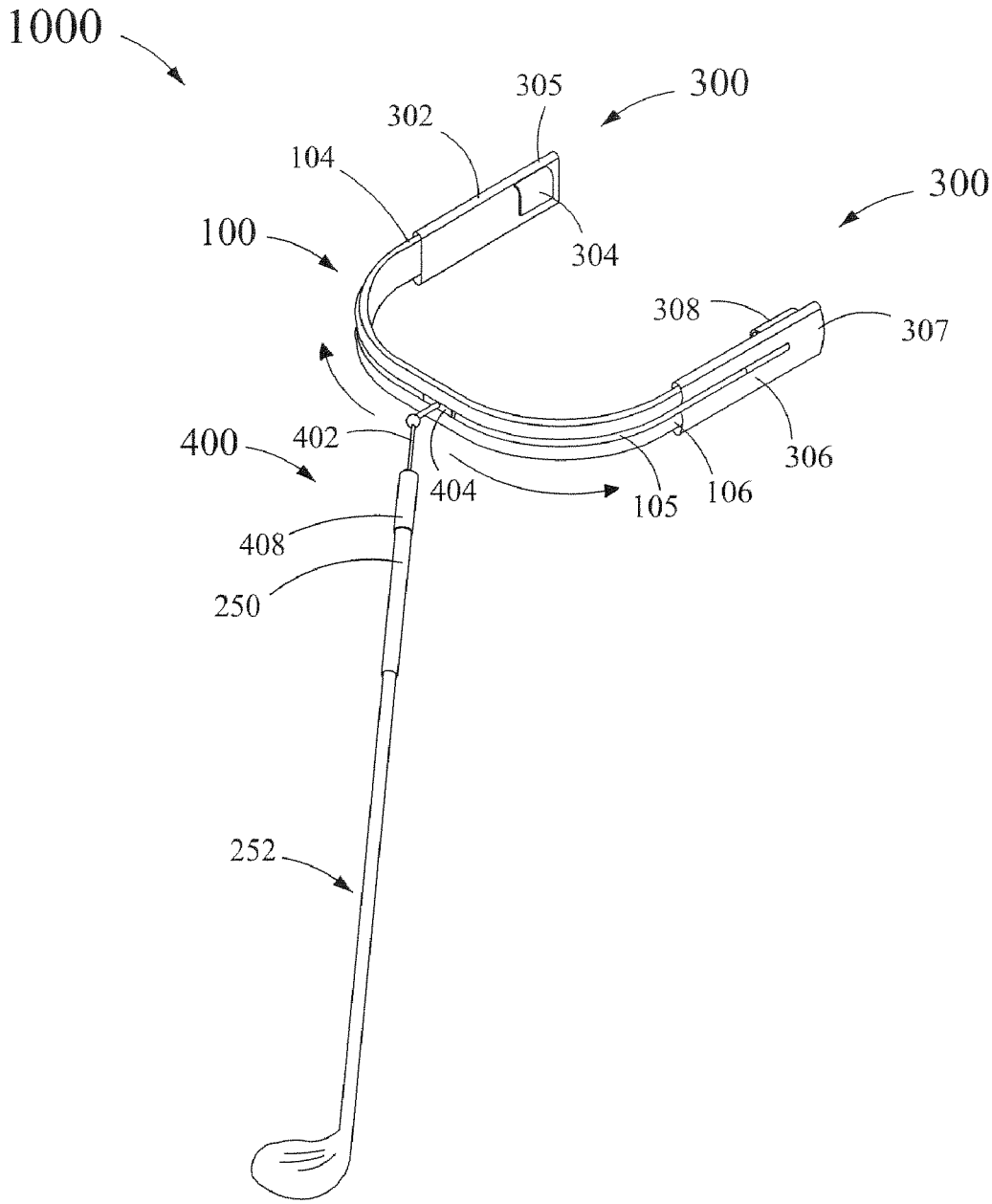
FIG. 2 is a perspective view of the golfing apparatus of FIG. 1 having a golf club received therein.
Figure 3:
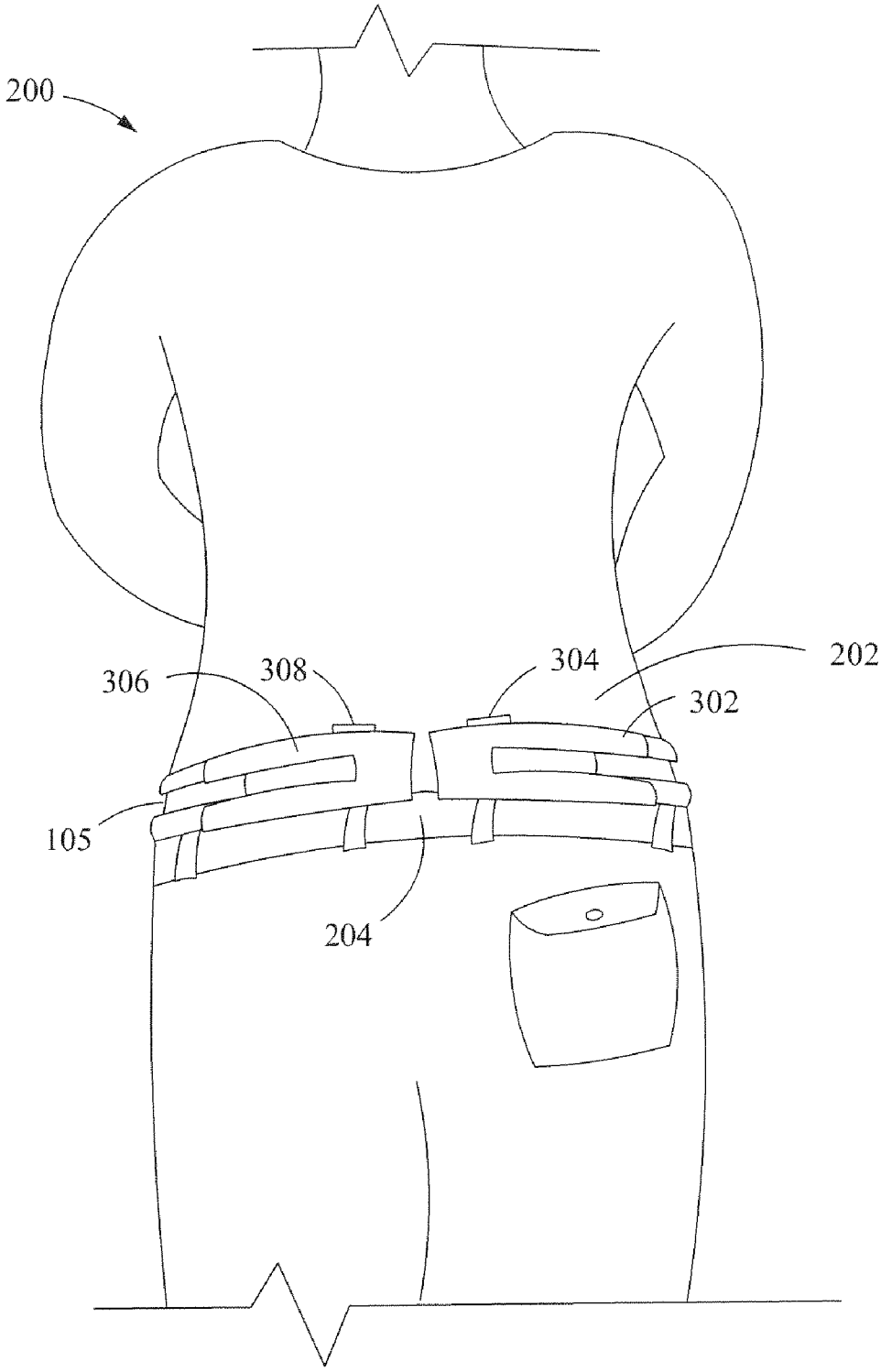
FIG. 3 is a view of the golfing apparatus of FIG. 1 secured to a waist of a golfer.

FIGS. 1-3 depict one embodiment of a golfing apparatus 1000. The golfing apparatus 1000 may include a belt member or elongated belt member 100. The belt member 100 may be adapted to be wrapped around a waist 202 of a golfer 200. The belt member 100 may include a groove 105. Further, the belt member 100 may include a first end portion 104, and a second end portion 106 opposite to the first end portion 104. As shown in FIGS. 1-3, the groove 105 may include an elongated furrow running across the length of the belt member 100. It should be understood that when the belt member 100 is wrapped around the waist 202 of the golfer 200, the groove 105 may get positioned substantially towards a front side of the golfer 200.

The belt member 100 may be composed of a metallic material. Alternatively, the belt member 100 may be composed of any other robust material, such as a plastic material, or a composite material. Specifically, the groove 105 may be composed of a metallic material, which may reduce the friction in the groove 105, and the rest of the belt member 100 may be composed of hard plastic material.

The golfing apparatus 1000 may further include an attaching member 300. The attaching member 300 may be secured to end portions, such as the first end portion 104 and the second end portion 106, of the belt member 100. The attaching member 300 may be adapted to secure the belt member 100 to the waist 202 of the golfer 200.

Specifically, as shown in FIGS. 1-3, the attaching member 300 may include a first attaching piece 302. The first attaching piece 302 may be adapted to telescopically receive the first end portion 104 of the belt member 100. Further, the first attaching piece 302 may include a first attaching clip 304 secured at a free end portion 305 thereof.

The attaching member 300 may further include a second attaching piece 306. The second attaching piece 306 may be adapted to telescopically receive the second end portion 106 of the belt member 100. Further, the second attaching piece 306 may include a second attaching clip 308 secured to a free end portion 307 thereof. Further, the first attaching piece 302 and the second attaching piece 306 may include complementary grooves, which conform to the groove 105 of the belt member 100.

As best shown in FIG. 3, the first attaching clip 304 and the second attaching clip 308 may be capable of being engaged with an accessory, such as a belt 204 of the golfer 200. The engagement of the first attaching clip 304 and the second attaching clip 308 with the belt 204 of the golfer 200 secures the belt member 100 to the waist 202 of the golfer 200. Moreover, it should be understood that extent of telescopic receiving of the first end portion 104 in the first attaching piece 302, and of the second end portion 106 in the second attaching piece 306 allows an adjustment of length of the attaching member. Such adjustment enables the belt member 100 to be secured to golfers of different waist sizes.

The first attaching piece 302 and the second attaching piece 306 may be composed of materials similar to the materials used in the belt member 100. Accordingly, the first attaching piece 302 and the second attaching piece 306 may be composed of a metallic material. Alternatively, the first attaching piece 302 and the second attaching piece 306 may be composed of any other robust material, such as a plastic material, or a composite material.

Figure 4:
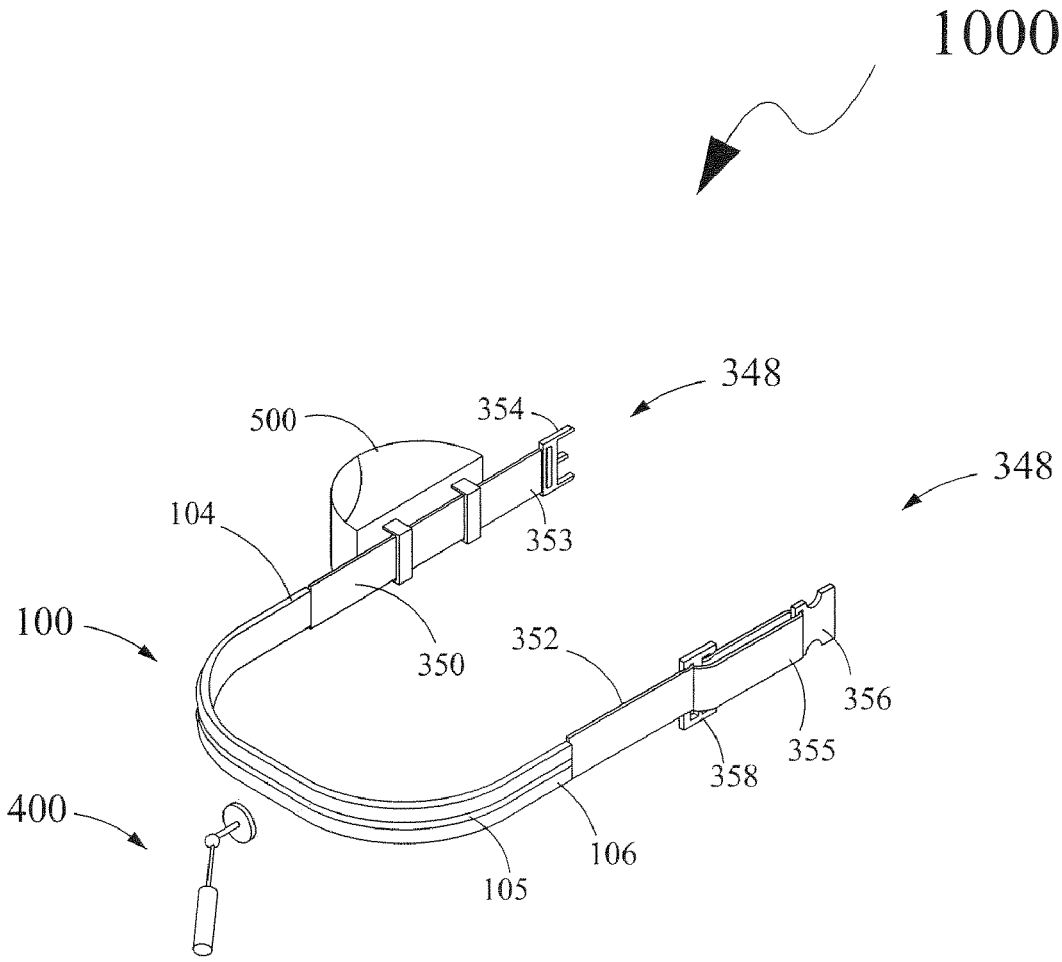
FIG. 4 is an exploded of another embodiment of the golfing apparatus.
Figure 5:
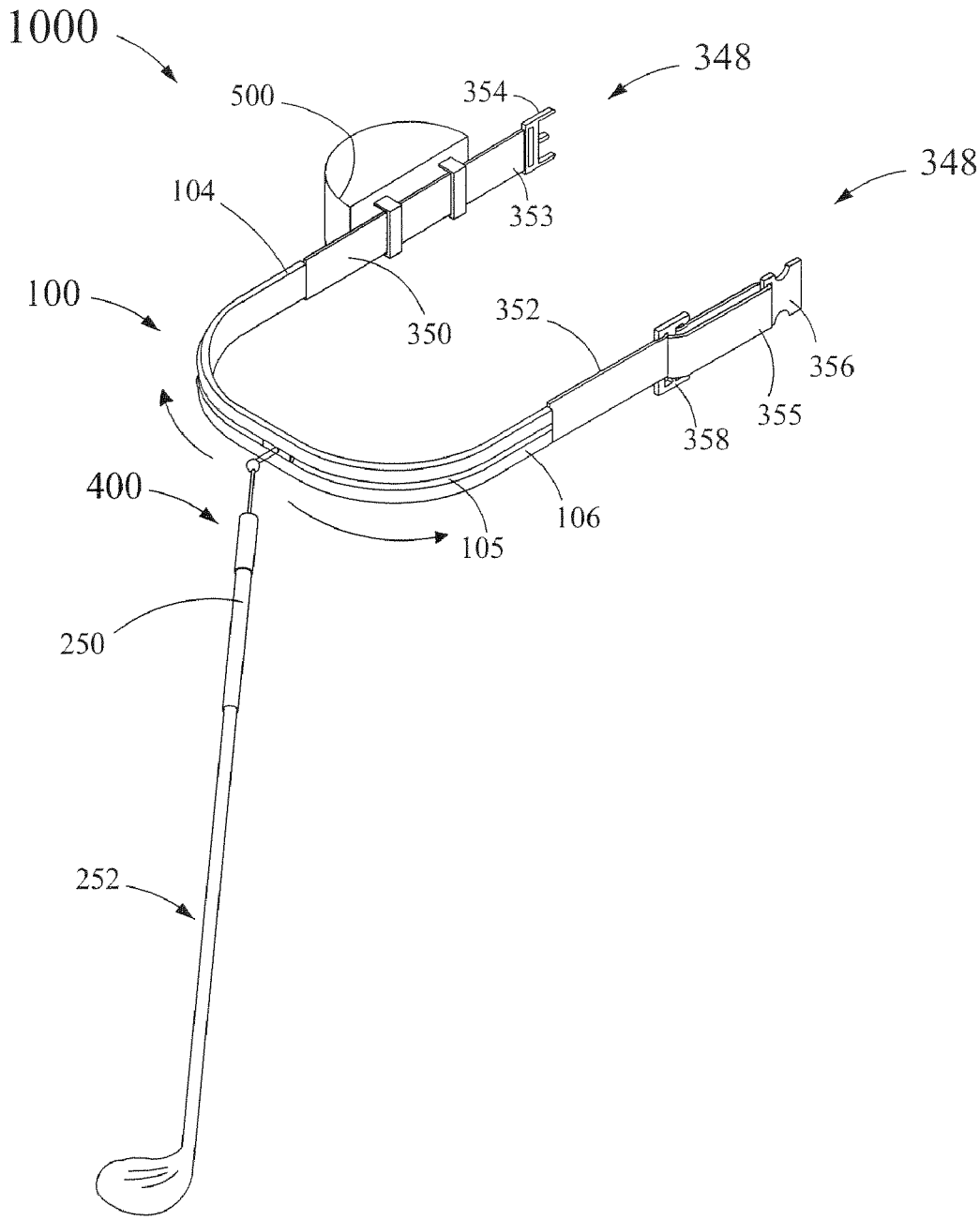
FIG. 5 is a perspective view of the golfing apparatus of FIG. 4 having a golf club received therein.
Figure 6:
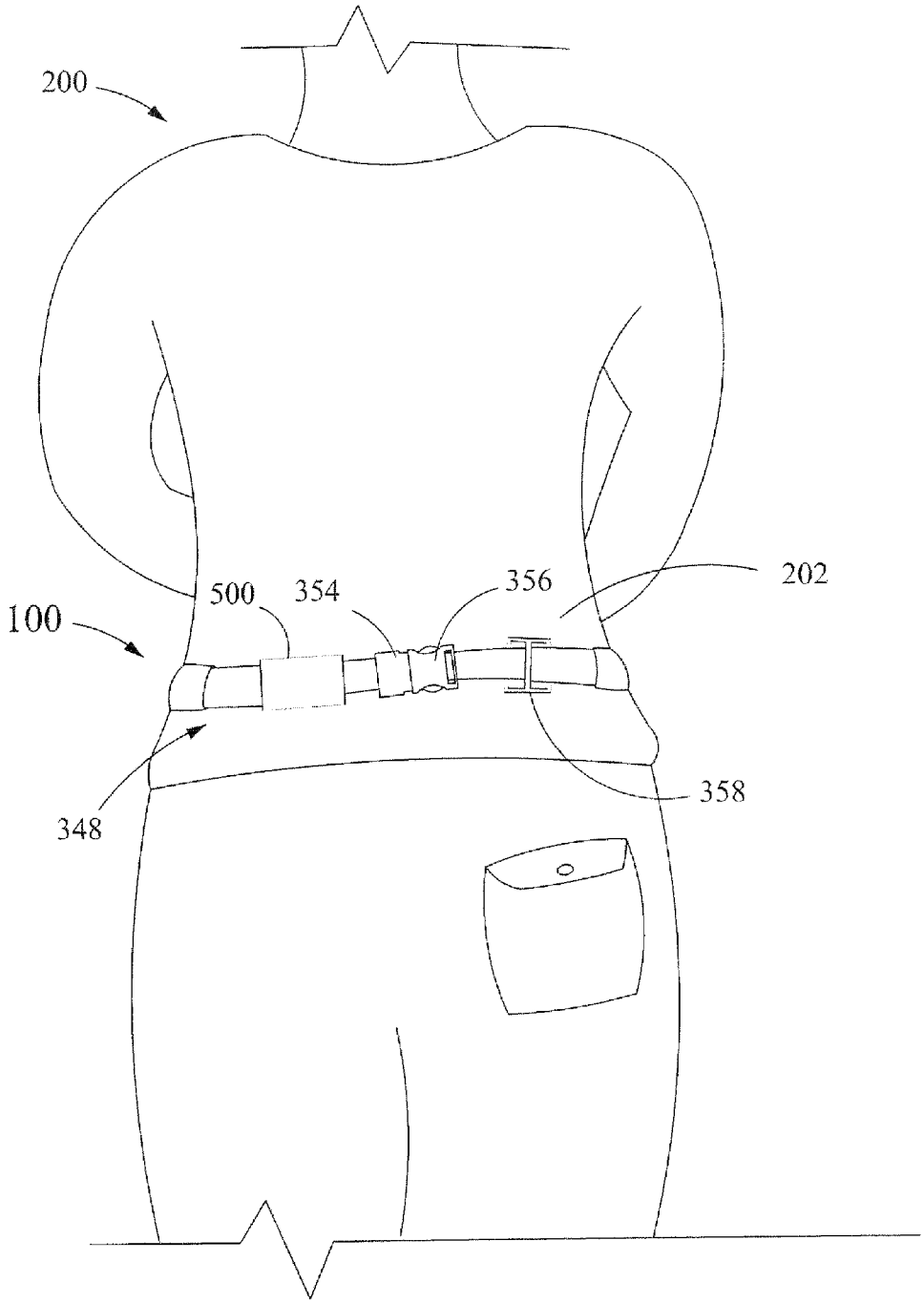
FIG. 6 is a view of the golfing apparatus of FIG. 4 secured to a waist of a golfer.
Figure 7:
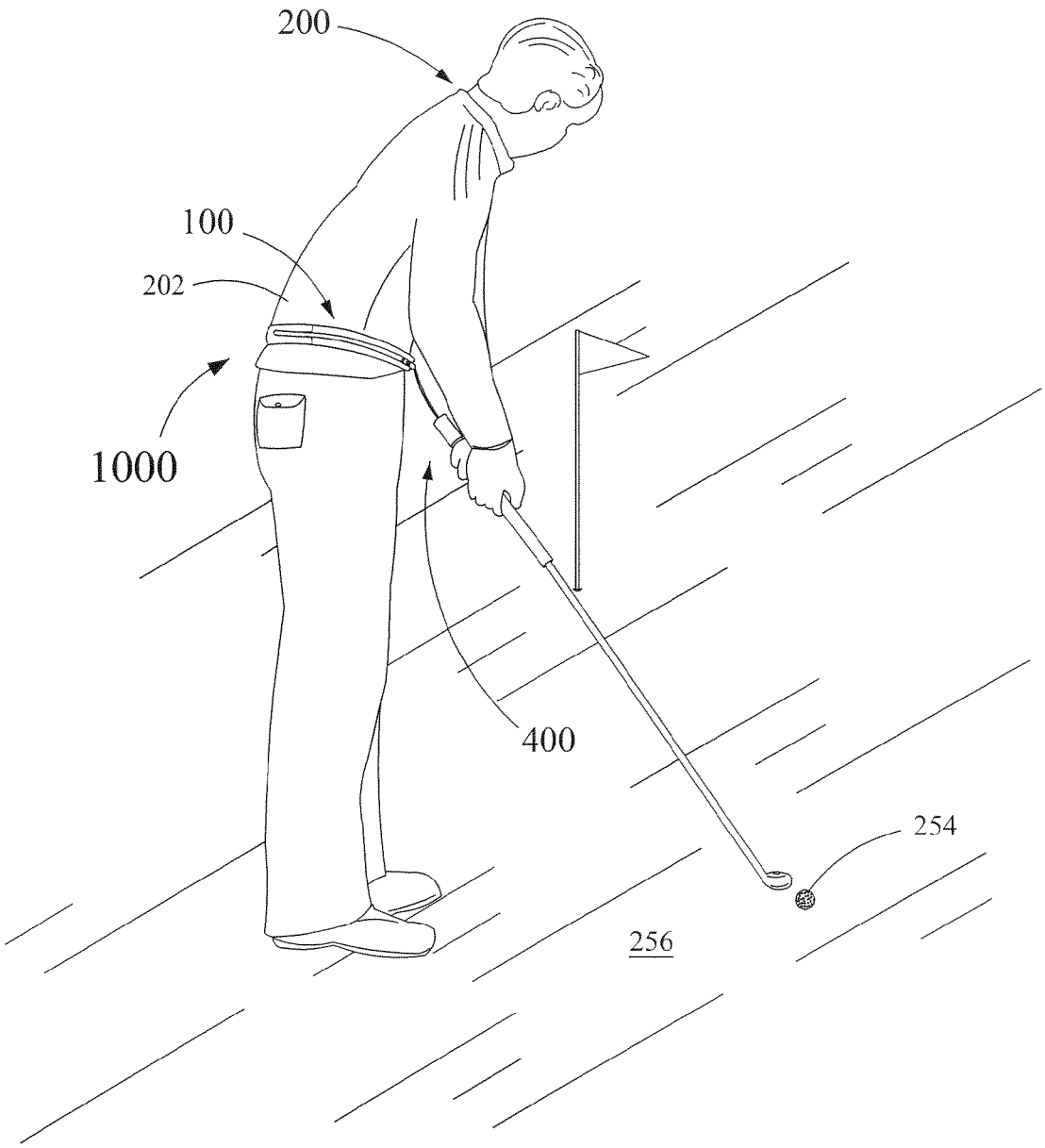
FIG. 7 is a perspective view of the golfing apparatus of FIGS. 1 and 4 in use.

In another embodiment of the present disclosure (as shown in FIGS. 4-6), the attaching member 300 may instead include adjustable straps. Such attaching member 300 is depicted in the FIGS. 4-6 as attaching member 348. Accordingly, the attaching member 348 includes a first adjustable strap 350 secured to the first end portion 104 of the belt member 100. Further, the attaching member 348 includes a second adjustable strap 352 secured to the second end portion 106 of the elongated belt member 100. Further, a free end of each of the first adjustable strap 350 and the second adjustable strap 352 may be adapted to be joined for securing the belt member 100 to the waist 202 of the golfer 200. More specifically, the free end portion 353 of the first adjustable strap 350 includes a male buckle member 354, and the free end portion 355 of the second adjustable strap 352 includes a female buckle member 356.

The female buckle member 356 may be adapted to be removably received within the male buckle member 354. Such receiving of the female buckle member 356 into the male buckle member 354 joins the first adjustable strap 350 with the second adjustable strap 352, thereby securing the belt member 100 to the waist 202 of the golfer 200.

Further, at least one of the first adjustable strap 350 and the second adjustable strap 352 includes an adjusting clip 358. In the FIGS. 4-6, the second adjustable strap 352 is shown to include the adjusting clip 358.

The adjusting clip 358 enables extension and retraction of at least one of the first adjustable strap 350 and the second adjustable strap 352 for adjusting a length thereof. Accordingly, the adjusting of the length of the at least one of the first adjustable strap 350 and the second adjustable strap 352 using the adjusting clip 358 enables securing of the elongated belt member 100 to golfers of different waist sizes.

It should be apparent to a person skilled in the art that aforementioned embodiments of the attaching member 300 should not be construed as limitations to the present disclosure. Accordingly, other attaching means, such as hook and loop straps, may also be utilized for securing the elongated belt member 100 to the waist 202 of the golfer 200.

The golfing apparatus 1000 further includes a guiding member 400. The guiding member 400 may be adapted to slidably engage in the groove 105 of the elongated belt member 100. Further, the guiding member 400 may be adapted to receive a handle portion 250 of a golf club 252 (as depicted in FIGS. 2 and 5).

Specifically, the guiding member 400 may include a rod 402. Further, the guiding member 400 may include an engaging piece 404 carried by a first first end portion 406 of the rod 402. The engaging piece 404 may be adapted to fit in the groove 105 of the elongated belt member 100 for sliding there-within.

As shown in FIG. 4, the engaging piece 404 may have a disc shaped structure. However, it should be understood that such structure of the engaging piece 404 should not be construed as a limitation to the present disclosure. Accordingly, the engaging piece 404 may alternatively be a roller, which may extend from the first end portion 406 of the rod 402. The roller may be fitted inside the groove 105 for sliding therewith.

Further, the guiding member 400 may include a socket 408 extending from a second end portion 410 of the rod 402. The socket 408 may be adapted to receive the handle portion 250 of the golf club 252. The socket 408 may also include a snap fit mechanism (not shown). The snap fit mechanism may be adapted to snap fit the handle portion 250 of the golf club 252 in the socket 408.

It should be understood that the slidable engaging of the engaging piece 404 in the groove 105 enables a free movement of the guiding member 400 in the groove 105. Such free movement may assist in guiding swing of the golf club 252 received in the socket 408, thereby assisting the golfer 200 in putting while playing golf.

Further, the golfing apparatus 1000 may include an auxiliary pouch 500. The auxiliary pouch 500 may be carried by one of the elongated belt member 100 and the attaching member 300. As best shown in FIG. 4, the auxiliary pouch 500 may be carried by the second adjustable strap 352. The auxiliary pouch 500 may be capable of receiving articles (not shown) such as, golf balls, putt markers.

During utilization of the golfing apparatus 1000, the elongated belt member 100 may be wrapped around the waist 202 of the golfer 200. Thereafter, the first attaching clip 304 and the second attaching clip 308 may be engaged with the belt 204 of the golfer 200 for attaching the belt member 100 to the waist 202 of the golfer 200. Alternatively, the male buckle member 354 may be joined with the female buckle member 356 for securing the belt member 100 to the waist 202 of the golfer 200. Such attaching of the belt member 100 to the waist 202 of the golfer 200 assists the golfer 200 in maintaining a proper posture or may act as a back brace. Thereafter, the handle portion 250 of the golf club 252 may be snap fitted to the socket 408 at the second end portion 410 of the guiding member 400 while the engaging piece 404 is fitted in the groove 105. Now, the golfer 200 may swing the golf club 252 for striking a golf ball 254 preferably positioned on a ground surface 256 of a golf course. During, such swing of the golf club 252 for striking the golf ball 254, the engaging piece 404 of the guiding member 400 freely moves within the groove 105. Such free movement of the guiding member 400 guides the swing of the golf club 252. The guiding of the swing of the golf club 252 assists the golfers 200 in playing golf.

The present disclosure provides a golfing apparatus, such as the golfing apparatus 1000, for assisting golfers in golfing. The golfing apparatus may include an attaching member, such as attaching member 300, for attaching an belt member, such as the belt member 100, around a waist of a golfer such as the golfer 200. The belt member 100 attached to the waist of the golfer assists the golfer in maintaining a proper posture. The golfing apparatus may include a guiding member, such as the guiding member 400. A handle portion, such as the handle portion 250 of a golf club, such as the golf club 252 may be snap fitted to the guiding member. The guiding member may be capable of guiding a swing of the golf club, thereby assisting the golfer in playing golf. The guiding to the swing of the golf club facilitates in providing a smooth and direct path to the golf club while playing golf. The assistance provided by the guiding enables the golfer in maintaining a good form while playing various types of golf shots.

The foregoing descriptions of specific embodiments of the present disclosure have been presented for purposes of illustration and description. They are not intended to be exhaustive or the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A golfing apparatus comprising:

a belt member configured to be wrapped around a waist of the golfer, the belt member comprising a groove and a first end portion and second end portion;

an attaching member carried by said end portions of the belt member, the attaching member configured to secure the belt member to the waist of the golfer; and a guiding member slidably engaged in the groove, the guiding member configured to receive a handle portion of a golf club therein.

2. The golfing apparatus of claim 1, wherein the attaching member comprises, a first attaching piece configured to telescopically receive said first end portion of the belt member, the first attaching piece comprising a first attaching clip, and a second attaching piece configured to telescopically receive said second end portion of the second belt member, the second attaching piece comprising a second attaching clip, wherein each of the first attaching clip and the second attaching clip is capable of being engaged with an accessory of the golfer for securing the belt member to the waist of the golfer.

3. The golfing apparatus of claim 2, wherein the extent of telescopic receiving of the first end portion in the first attaching piece and the second end portion in the second attaching piece allows an adjustment of length of the attaching member.

4. The golfing apparatus of claim 2, wherein the accessory comprises a belt of the golfer.

5. The golfing apparatus of claim 1, wherein the attaching member comprises, a first adjustable strap secured to said first end portion of the belt member, and a second adjustable strap secured to said second end portion of the belt member, wherein a free end portion of the first adjustable strap and a free end portion of the second adjustable strap are configured to be joined for securing the belt member to the waist of the golfer.

6. The golfing apparatus of claim 5, wherein the first adjustable strap comprises a male buckle member carried by the free end portion thereof, and the second adjustable strap comprises a female buckle member carried by the free end portion thereof, and wherein the male buckle member and the female buckle member are configured to be removably engaged for securing the belt member to the waist of the golfer.

7. The golfing apparatus of claim 1, wherein the guiding member comprises, a rod having a first end portion and a second end portion opposite to the first end portion, an engaging piece carried by the first end portion of the rod, the engaging piece configured to be fitted in the groove for sliding the guiding member in the groove, and a socket carried by the second end portion of the rod, the socket capable of receiving the handle portion of the golf club.

8. The golfing apparatus of claim 1, wherein the belt member is composed of a metallic material.

9. The golfing apparatus of claim 1 further comprising an auxiliary pouch member removably carried by one of the belt member and the attaching member, the auxiliary pouch member configured to carry one or more golfing articles therein.

* * * * *

UNITED STATES PATENT AND TRADEMARK OFFICE

CERTIFICATE OF CORRECTION

PATENT NO. : 7,993,210 B1
APPLICATION NO. : 12/777346
DATED : August 9, 2011
INVENTOR(S) : Hatfield It is certified that error appears in the above-identified patent and that said Letters Patent is hereby corrected as shown below:

Col. 5, Line 25 Insert -- to limit -- after or

Signed and Sealed this
Eighteenth Day of October, 2011

David J. Kappos

David J. Kappos
*Director of the United States Patent and Trademark Office*